US005351378A

United States Patent [19]

Hsien-Chung

[11] Patent Number: 5,351,378

[45] Date of Patent: Oct. 4, 1994

[54] METHOD FOR AUTOMATIC MANUFACTURING OF JEWELRY AND ORNAMENTS

[76] Inventor: Fang Hsien-Chung, Suite 1, 11F, 95-8 Chang Ping Road, Sec. 1, Taichung, Taiwan

[21] Appl. No.: 11,886

[22] Filed: Feb. 2, 1993

[51] Int. Cl.[5] ..... B23P 13/00

[52] U.S. Cl. ..... 29/160.6; 63/2

[58] Field of Search ..... 29/160.6; 63/2

[56] References Cited

U.S. PATENT DOCUMENTS 442,757 12/1890 Schlosstein ..... 29/160.6

5,152,042 10/1992 Mayers ..... 29/160.6

*Primary Examiner*—P. W. Echols

[57] ABSTRACT

A method for the automatic manufacture of jewelry and ornaments comprising six steps. The characteristic of this disclosure is the introduction of laser paper and print transfer which simplifies the manufacturing process and facilitates for automatic mass production. Another advantage of this disclosure is the adaptation of a hollow rectangular neck for use in rivet assembly that makes for a more stable finished product.

2 Claims, 4 Drawing Sheets

METHOD FOR AUTOMATIC MANUFACTURING OF JEWELRY AND ORNAMENTS

BACKGROUND OF THE INVENTION

The present invention relates to jewelry and ornaments, and more particularly to a method for the manufacturing of jewelry and ornaments under an automated process which will reduce both the consumption of manpower and production costs.

Jewelry and ornaments now selling on the market have a variety of styles. These styles are classified into three general types; arcuate, embossed, and flat. The arcuate and embossed types of jewelry and ornaments vary in material, and manufacturing method. The most prevalent style of jewelry and ornaments on the market today is the flat type. The production of the flat type requires a lot of manpower, as there are many production steps which require manual labor, such as the painting and application of colors and designs onto the surface areas of the product. The necessity of skilled crafts people to make these products adds to the production cost. Because of this, a method of printing and design transfer was adapted. The printing and design transfer method most prevalently adapted includes the following steps (refer to FIG. 1 ). 1) press forming on rolling metal plate, 2) cleaning the surface with soda water, 3) blowing drying the pieces, 4) arranging the pieces for the application of adhesive, 5) oven drying the pieces, 6) arranging the pieces for heat transfers, 7) assembly of final product. The production method described, uses manual application of Epoxy onto the surface of the semi-finished product, prior to drying it in an oven at a temperature of about 110° C. for up to 90 minutes. The semi finished product is then rearranged for the application of color and or print transfer, which is then thermally treated for about 30 seconds. The product is then ready for final assembly. However, the following disadvantages exist.

(a) The manual application of Epoxy onto the surface of the semi-finished product, can cause uneven membranes on the surface, which becomes an obstacle with automatic arrangement. Furthermore, the Epoxy will not properly adhere to surfaces which have been unavoidably stained by body oils, and finger prints. This leaves a potential for flawed products.

(b) To remove the body oil and fingerprints that are unavoidably left on the semi-finished product, an immersion into soda water is required. The water is then spun off in a centrifuge, and the semi-finished product is oven dried, all of which prolongs the manufacturing process, and increases production cost.

(c) The centrifuge process invariably damages some of the pieces because of the impact and friction involved. The percentage of defects from this step is about 40%.

(d) A lot of manpower is needed, and consumed with the repeated manual arrangement of the semi-finished product. As a consequence, it is difficult to reduce manufacturing costs.

SUMMARY OF THE PRESENT INVENTION

The main object of the present invention is to provide a method for the automatic manufacture of jewelry and ornaments. The method introduces a heat transfer printing procedure that helps eliminate steps from the conventional manufacturing method, which consumes manpower and increases costs. The main step that is eliminated, is that which provides for the removal of finger prints and oil stains that occur with the manual arrangement of semi-finished pieces.

Another object of this invention is to provide an automatic manufacturing method to speed up the working process in the mass production of jewelry and ornaments. Accordingly this method is the application of a laser paper onto the surface of a rolled metallic plate. (Laser paper is herein defined as a type of paper with a vinyl or plastic type coating which is in the form of raised ridges. These ridges create optical changes in accordance with the movement of the paper.) The plate is subsequently cut off into predetermined breadth, the cut pieces are then press formed, making flat semi-finished products of jewelry and ornament pieces. The semi-finished products are then arranged in rows on a working station, in positions that are in registry with the patterns on a heat transfer paper. The heat transfer paper is applied to the semi-finished products, and heat is directly applied at a temperature of about 150° C. up to 190° C., for about 15 seconds. This step completes the transfer of the pattern, and does not entail the complication of human fingerprints, and oils. The pieces are now ready for final assembly, and are riveted together along with the necessary pins, and or other attachments to complete the jewelry and ornaments.

The steps of manufacture which allowed the fingerprints and human oils to attach themselves, have been eliminated, so the step that requires their removal has also been eliminated. This makes for a more efficient method of manufacture, cutting down on labor and time, as well as eliminating potential flaw areas.

Further objects and advantages of the present invention will become readily apparent with reference to the ensuing descriptions and drawings.

DETAILED DESCRIPTION OF THE PREFERRED EMBODIMENT OF THE PRESENT INVENTION

Figure 1:
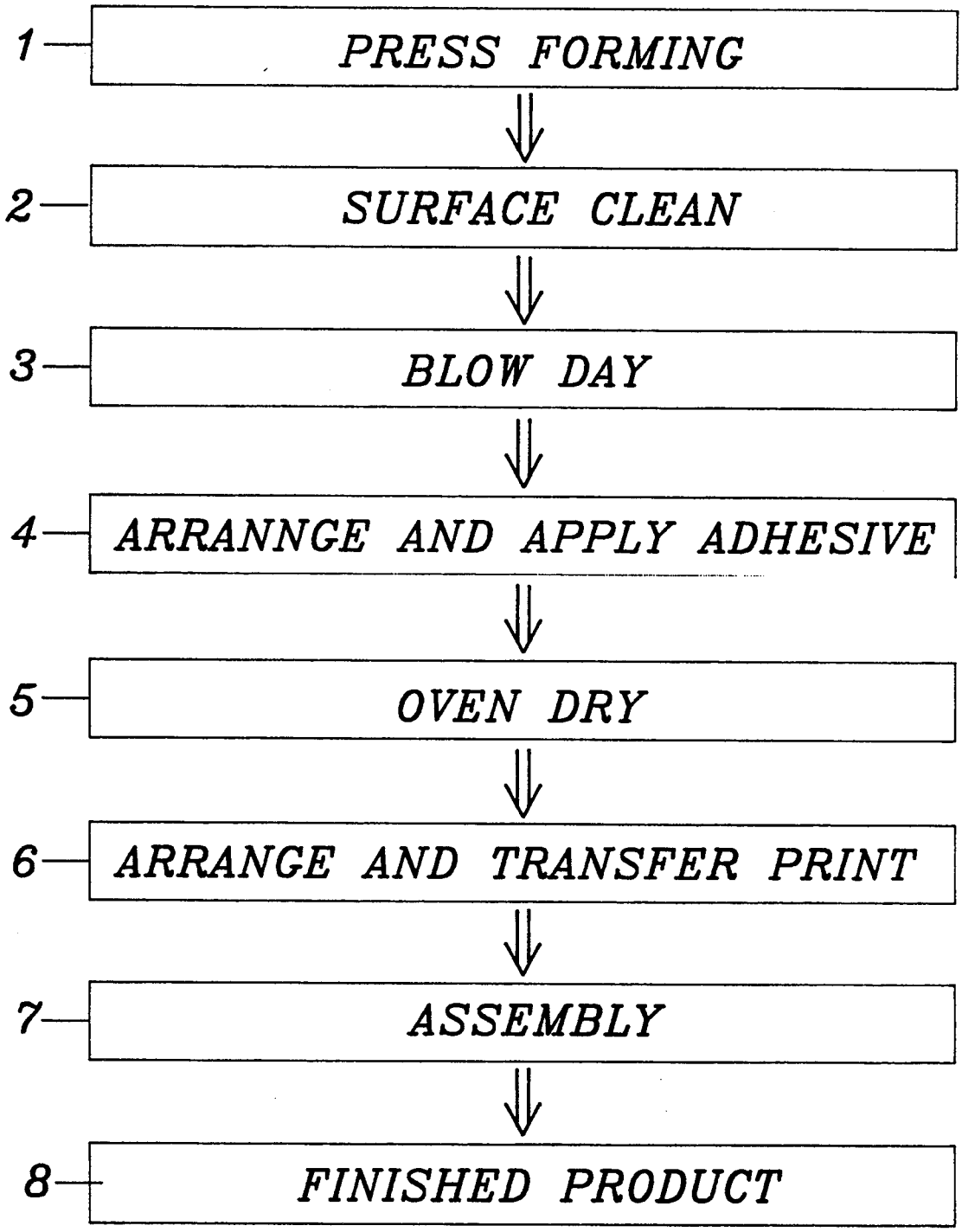
FIG. 1 PRIOR ART
FIG. 1 is a flow chart illustrating the manufacturing process according to prior art.
Figure 2:
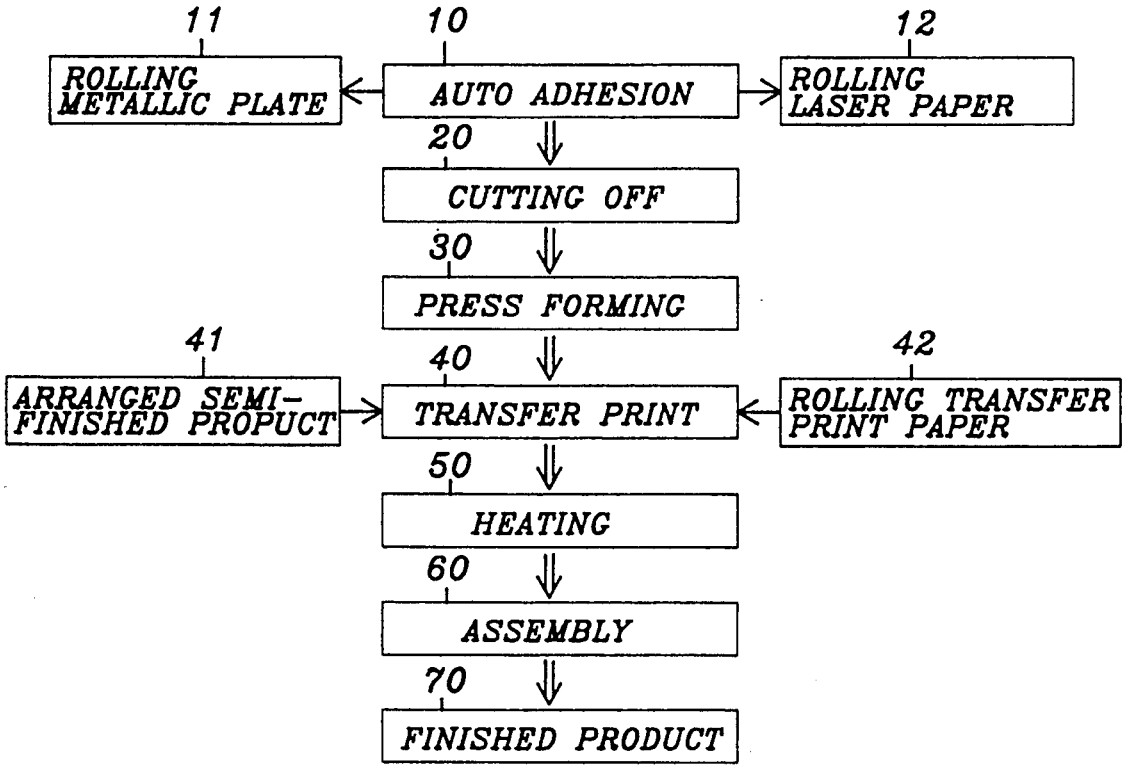
FIG. 2 is a flow chart illustrating the manufacturing process according to the present invention.

Referring to FIG. 2, The flow-chart represents the present invention comprising a method for the automatic manufacture of jewelry and ornaments. The method proceeds with the following steps.

Step 1 involves the automatic adhesion 10 of a rolling metallic plate 11, with a roll of laser paper 12. After the laser paper is adhered to the metallic plate, it proceeds to the cutting stage.

Step 2 involves the cutting off 20 of pieces of metal from the now adhered metallic plate, and laser paper. The pieces are automatically cut off into smaller working pieces of a predetermined breadth. The smaller working pieces are now ready for the press forming stage.

Step 3 involves the press forming 30 of the smaller working pieces. The smaller working pieces are press formed into flat semi-finished pieces by way of an automatic press. The semi-finished pieces are now ready for the print transfer stage.

Step 4 is the transfer print 40 stage. The arranged semi-finished products 41 are set flat in rows, in predetermined positions with the laser paper side facing up. The semi-finished pieces are then moved along a work station where the transfer print 40 takes place. The pieces are moved along in registry with the rolling transfer print paper 42. At this point the printed paper is laid upon the semi-finished pieces which together proceed toward the heating stage.

Step 5 involves the heating 50 of the printed paper onto the semi-finished pieces. The semi-finished pieces are heated with their new cover of printed paper in an oven which is set at a temperature of about 150° C. and up to about 190° C. for about 15 seconds. The semi-finished pieces are now ready for the assembly stage.

Figure 3:
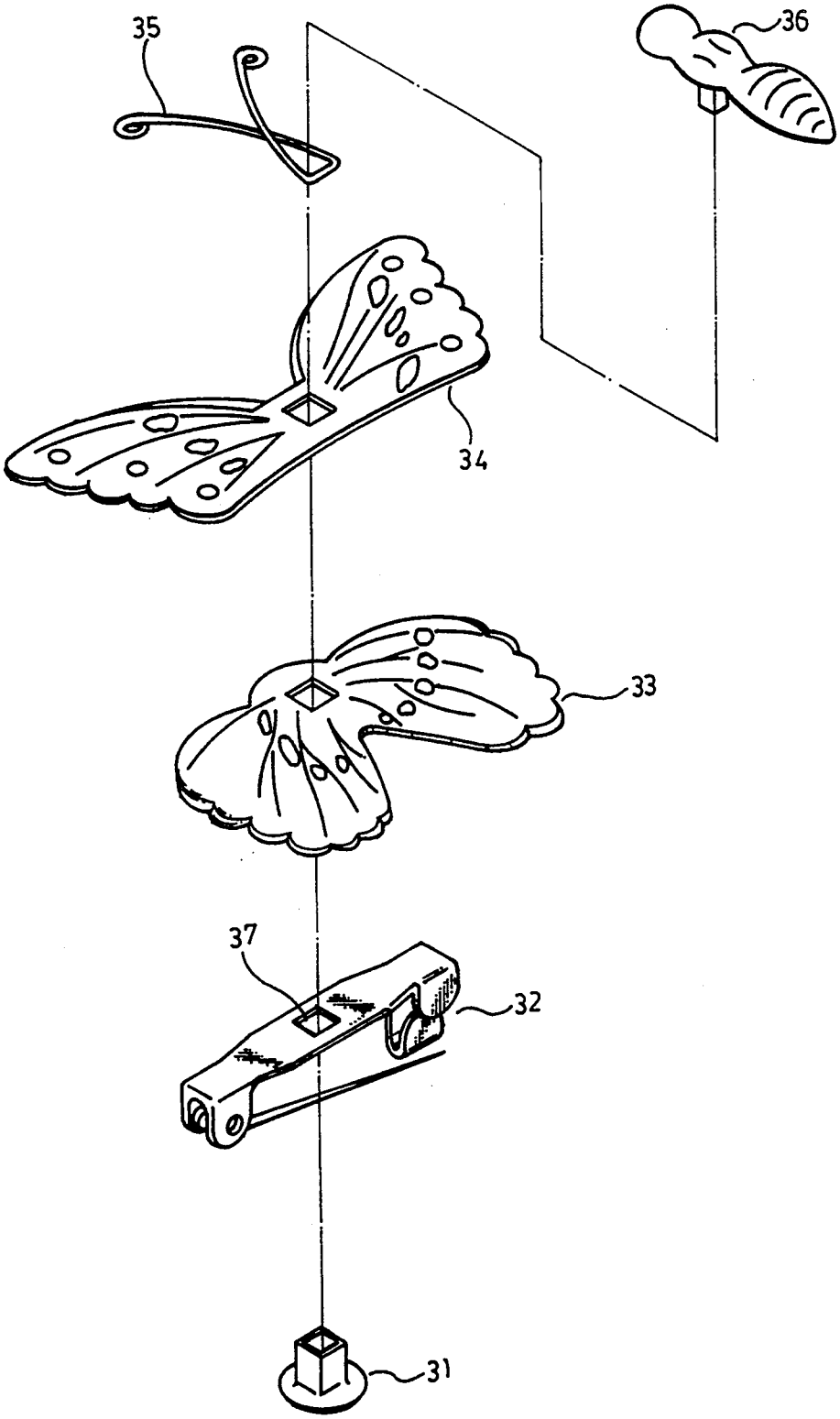
FIG. 3 is an exploded perspective view of a butterfly brooch according to the present invention.

Step 6 involves the assembly 60 of a final product. Referring to FIG. 3 the figures illustrate a butterfly brooch under final assembly. The completed brooch is assembled automatically, from 6 separate parts. There are two outer parts with rivets, the body/tail 36, with a rivet bolt on its underside, and an eye bolt rivet 31, which has a rectangular neck. There are 4 inner pieces, which are held together by the 2 outer pieces. The inner pieces being from top to bottom, a feeler 35, an upper wing piece 34, a lower wing piece 33, and a safety pin piece 32. The assembly is automatic, with the body/tail 36 piece being riveted through holes 37 of the feeler 35, the upper wing piece 34, the lower wing piece 33, and the safety pin piece 32, and into the hollow rectangular neck of the eye bolt rivet 31.

Figure 4:
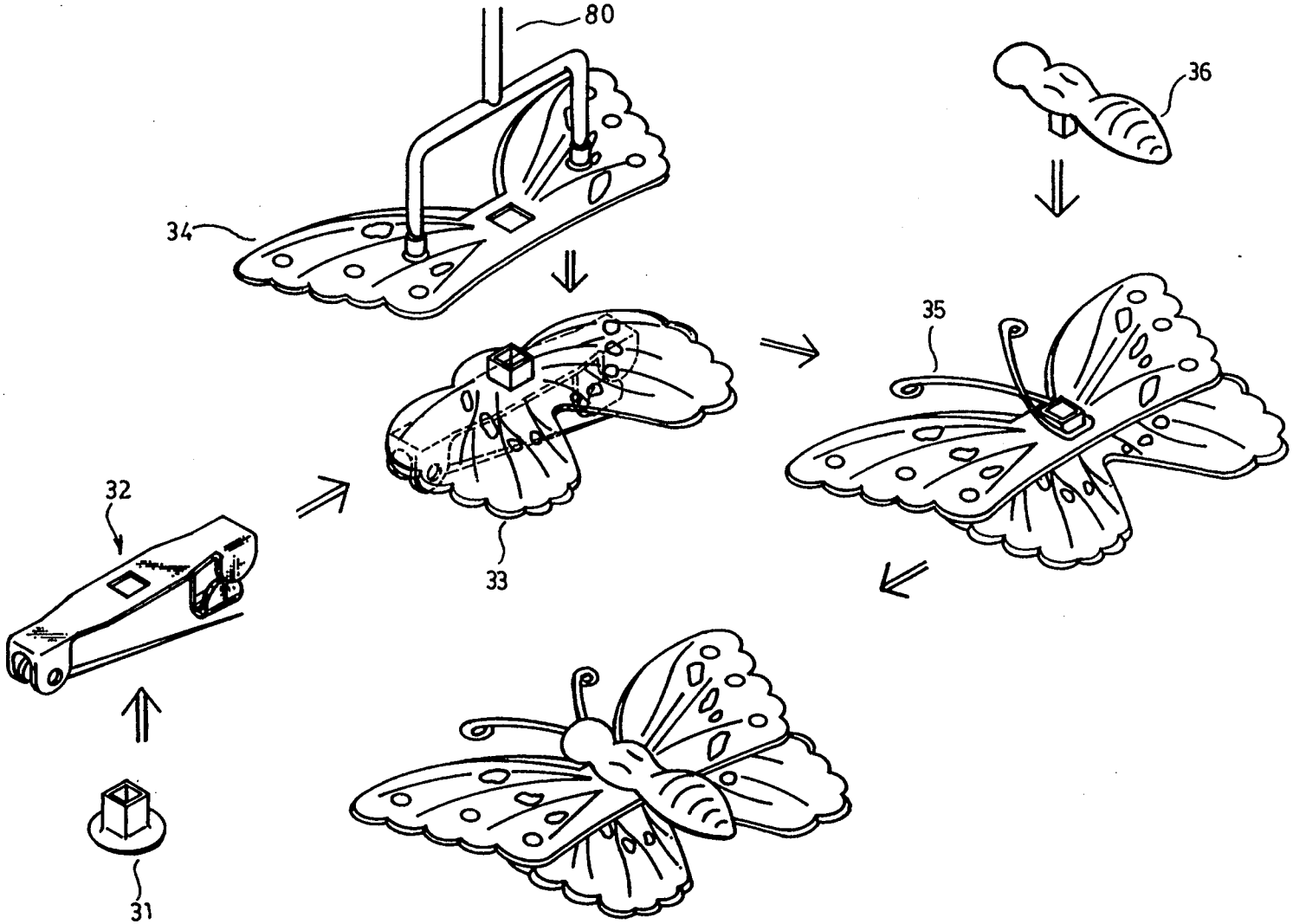
FIG. 4 is an exploded perspective view illustrating the assembly of a butterfly brooch according to FIG. 3.

Referring to FIG. 4, The automatic assembly includes the use of a suction nozzle 80, to place the wing sections 34, 33, in sequence with the other pieces, over and around the extended neck portion of the eye bolt rivet 31. When all pieces are in sequence around the extended neck portion of the eye bolt rivet 31, the extended rivet portion on the underside of the body/tail is then riveted into the hollow neck portion of the eye bolt rivet 31.

The final assembly of the butterfly brooch using the method of manufacture described, presents a durable and colorful product that is less expensive to make, and has less potential for flaws than that of the prior art methods.

Based on the aforementioned steps, the present invention for the automatic manufacture of jewelry and ornaments provides the following advantages.

(a) it introduces a laser paper transfer and printing procedure that reduces the consumption of manpower, and reduces the occurrence of flawed products.

(b) the stacked assembly is ideal for automatic manufacture, and mass production.

(c) the adhesion and transfer of prints and colors to surface areas of the products manufactured by this method are stronger and more reliable than the adhesion onto Epoxy surfaces.

The scope of this invention should be determined by the appended claims and their legal equivalents, rather than by the examples given.

I claim:

1. A method for the manufacture of jewelry and ornaments in an automatic assembly line comprising the following six steps:

step 1, an automatic adhesion of a rolling metallic plate with a roll of laser paper;

step 2, cutting of the now cohesive metallic plate and laser paper into smaller working pieces of predetermined breadth;

step 3, press forming the smaller working pieces into semi-finished products with an automatic press;

step 4, arrangement of semi-finished products in rows with predetermined positions, the pieces having their laser paper side facing up, for the transfer of colored and or patterned print paper which has been set in registry with the pieces on the automatic assembly line;

step 5, application of heat to print transfer paper at a temperature of about 150° C. up to 190° C. for about 15 seconds, to complete the solid transfer of colors and patterns to the semi-finished products;

step 6, automatic assembly of semi-finished products in a stacked manner using suction nozzles and rivet joints to form a finished product.

2. The method according to claim 1, wherein said rivet has been made of a hollow rectangular neck to enhance the stability of the finished product.

* * * * *